US006032480A

United States Patent [19]

Kim

[11] Patent Number: 6,032,480

[45] Date of Patent: Mar. 7, 2000

[54] REFRIGERATOR HAVING A DEVICE FOR OPENING/CLOSING COOL AIR DISCHARGE PORTS

[75] Inventor: Jae-in Kim, Seoul, Rep. of Korea

[73] Assignee: Samsung Electronics Co., Ltd., Suwon, Rep. of Korea

[21] Appl. No.: 09/057,489

[22] Filed: Apr. 9, 1998

[30] Foreign Application Priority Data

| | | | |
|---|---|---|---|
| Apr. 18, 1997 | [KR] | Rep. of Korea | 97-14298 |
| Jul. 23, 1997 | [KR] | Rep. of Korea | 97-19403 U |
| Jul. 23, 1997 | [KR] | Rep. of Korea | 97-34355 |
| Jul. 31, 1997 | [KR] | Rep. of Korea | 97-20623 U |

[51] Int. Cl.[7] ..... F25D 17/04

[52] U.S. Cl. ..... 62/408; 62/187

[58] Field of Search ..... 62/407, 408, 419, 62/180, 186, 187

[56] References Cited

U.S. PATENT DOCUMENTS

| | | | |
|---|---|---|---|
| 2,660,036 | 11/1953 | Moore . | |
| 4,282,720 | 8/1981 | Stottmann et al. | 62/180 |
| 4,688,393 | 8/1987 | Linstromberg et al. | 62/187 |
| 4,732,010 | 3/1988 | Linstromberg et al. | 62/187 |
| 5,191,774 | 3/1993 | Park . | |
| 5,490,395 | 2/1996 | Williams et al. | 62/187 |

FOREIGN PATENT DOCUMENTS

| | | |
|---|---|---|
| 4-268183 | 9/1992 | Japan . |
| 4-136487 | 12/1992 | Japan . |

*Primary Examiner*—William Doerrler
*Attorney, Agent, or Firm*—Burns, Doane, Swecker & Mathis, L.L.P.

[57] ABSTRACT

A refrigerator is disclosed which is capable of preventing heat exchange between an evaporator and an outside air during a defrosting operation and/or when a door is open. The refrigerator has a device for opening/closing cool air discharge ports formed at a cool air duct. The opening/closing device includes opening/closing member for opening/closing the cool air discharge ports and a driving device for driving the opening/closing member. The cooling efficiency is enhanced and the frost caused by the outside air is not generated on the evaporator.

1 Claim, 9 Drawing Sheets

REFRIGERATOR HAVING A DEVICE FOR OPENING/CLOSING COOL AIR DISCHARGE PORTS

BACKGROUND OF THE INVENTION

1. Field of the Invention

The present invention relates to a refrigerator, and more particularly, to a refrigerator having a device for opening/closing cool air discharge ports during a defrosting operation and/or when a door is open.

2. Related Art

As shown in FIG. 1, a general refrigerator has a body 14 forming a freezing compartment 15 and a fresh food compartment 1, doors 16 and 12 for opening/closing the freezing compartment 15 and the fresh food compartment 1 respectively, a compressor 19 for compressing refrigerant, an evaporator 11 for generating cool air by evaporating the refrigerant supplied from the compressor 19, and a fan 20 for blowing the cool air generated by the evaporator 11.

A duct member 3 for forming a cool air duct 2 is installed at the rear part of the fresh food compartment 1. The duct member 3 has a plurality of cool air discharge ports 3*a* opened in the fresh food compartment 1. The cool air blown by the fan 20 flows into the cool air duct 2, and then is discharged into the fresh food compartment 1 through the cool air discharge ports 3*a*. In the cool air duct 2, a guide device 13 for guiding the cool air flowing into the cool air duct 2 toward the cool air discharge ports 3*a* is installed.

While the refrigerator operates, frost is generated on the evaporator 11. The cooling efficiency of the evaporator 11 is lowered by the frost. Hence, the refrigerator is equipped with a heater 17 for removing the frost, and performs defrosting operation by heating the evaporator 11 using the heater 17 when the refrigerator is used more than a predetermined period of time.

In such a conventional refrigerator, there is a problem that the heat generated by the heater 17 during the defrosting operation is transmitted into the fresh food compartment 1. The heat generated by the heater 17 is mainly transmitted through the same path with the path for supplying the cool air. That is, the heat is mainly transmitted to the fresh food compartment 1 through the cool air duct 2 and the cool air discharge ports 3*a*. Due to the heat transmitted to the fresh food compartment 1, the cooling efficiency of the fresh food compartment 1 is lowered, and the status of the food stored therein cannot be maintained properly.

Furthermore, when a user opens the door 12 of the fresh food compartment 1, the outside warm air flows into the fresh food compartment 1, which mainly flows into the area adjacent to the evaporator 11. When the outside air flows toward the evaporator 11, the frost is generated much more on the evaporator 11. Then, the defrosting operation should be performed more frequently. The heater 17 must be operated in order to perform the defrosting operation, so the cooling efficiency is still more lowered by the frequent defrosting.

SUMMARY OF THE INVENTION

The present invention has been proposed to overcome the above described problems in the prior art, and accordingly it is the object of the present invention to provide a refrigerator which is capable of preventing transmission of the heat generated by a heater during the defrosting operation and preventing an inflow of outside warm air toward the evaporator when a door is open.

The refrigerator according to the present invention has a door for opening/closing a cooling compartment; an evaporator for generating cool air to be supplied into the cooling compartment by evaporating refrigerant; a heater for removing frost generated on the evaporator; a duct member for forming a cool air duct into which the cool air generated by the evaporator flows, the duct member being formed with a plurality of cool air discharge ports opened in the cooling compartment; and an opening/closing device for closing the cool air discharge ports during a defrosting operation of the heater and/or when the door is open.

According to the preferred embodiment of the present invention, the opening/closing device comprises an opening/closing member being in close contact with the duct member, the opening/closing member being formed with air holes corresponding to the cool air discharge ports; a cam being disposed under the opening/closing member, the cam for supporting the opening/closing member; and a motor for driving the cam so that the cool air discharge ports are opened/closed by the opening/closing member.

According to another embodiment of the present invention, the opening/closing device comprises an opening/closing member being in close contact with the duct member, the opening/closing member being formed with air holes corresponding to the cool air discharge ports; a rack being formed in a body with the opening/closing member; a pinion being engaged with the rack; and a motor for driving the pinion so that the cool air discharge ports are opened/closed by the opening/closing member.

According to still another embodiment of the present invention, the opening/closing device comprises an opening/closing member being in close contact with the duct member, the opening/closing member being formed with air holes corresponding to the cool air discharge ports; a motor being fixed on the opening/closing member; a driving gear being rotated by the motor, the driving gear being inserted into a long hole formed on the duct member; and a gear part being formed at an inner side of the long hole, the gear part being engaged with the driving gear. The opening/closing member is formed with protrusion parts being form-fittingly inserted into the cool air discharge ports when the cool air discharge ports are closed thereby, and the long hole is bent so that the protrusion parts is moved to be inserted into the cool air discharge ports when the opening/closing member is operated to close the cool air discharge ports. Therefore, the cool air discharge ports are closed more airtightly.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
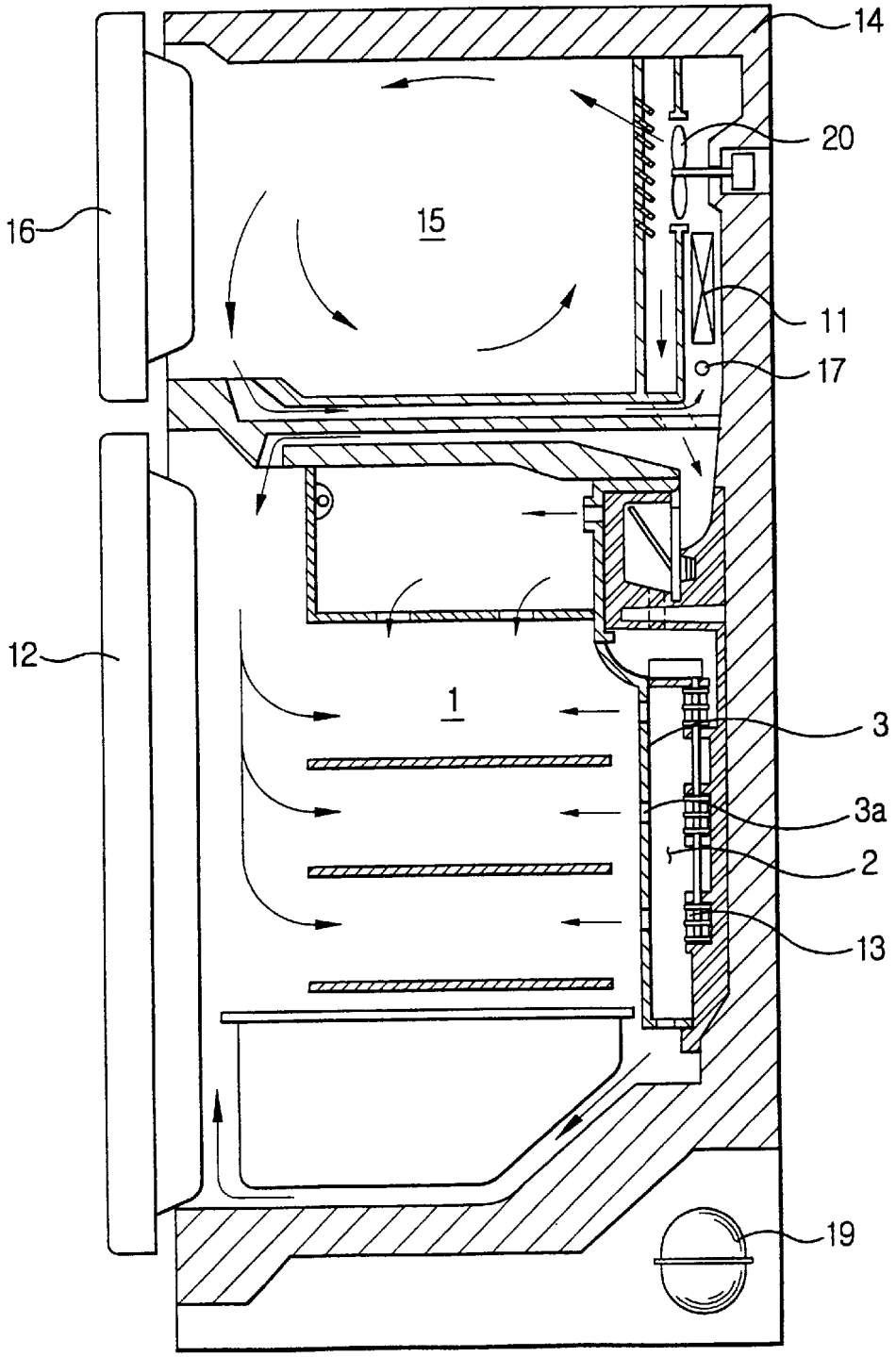
FIG. 1 (PRIOR ART)
FIG. 1 is a side sectional view of a general refrigerator.

Hereinafter, the present invention will be described in detail with reference to the drawings. The same parts with the parts of the conventional refrigerator shown in FIG. 1 will be referred to with the same reference numerals, and the description thereof will be omitted.

Figure 2:
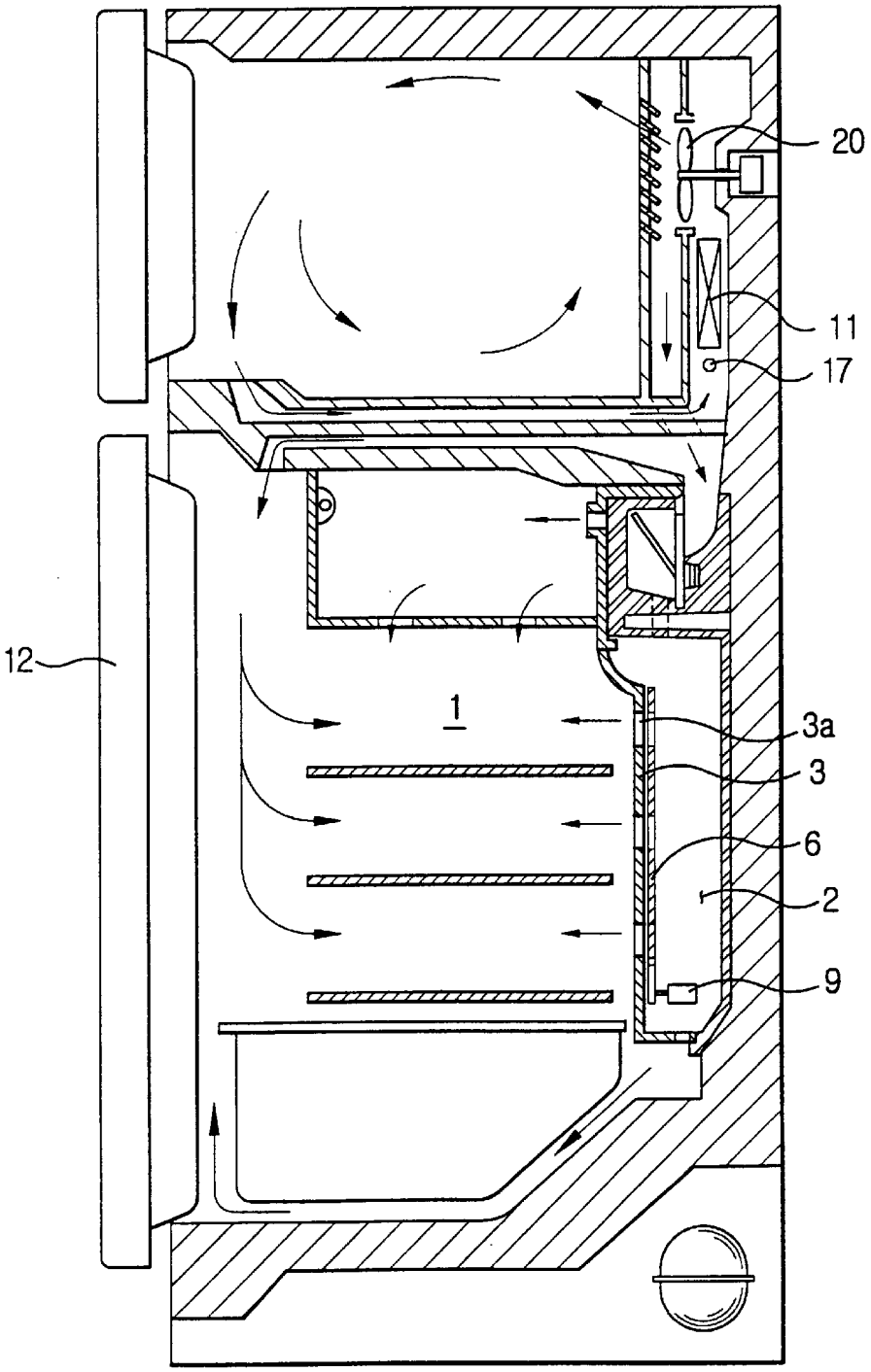
FIG. 2 is a side sectional view of a refrigerator according to the first embodiment of the present invention.
Figure 3:
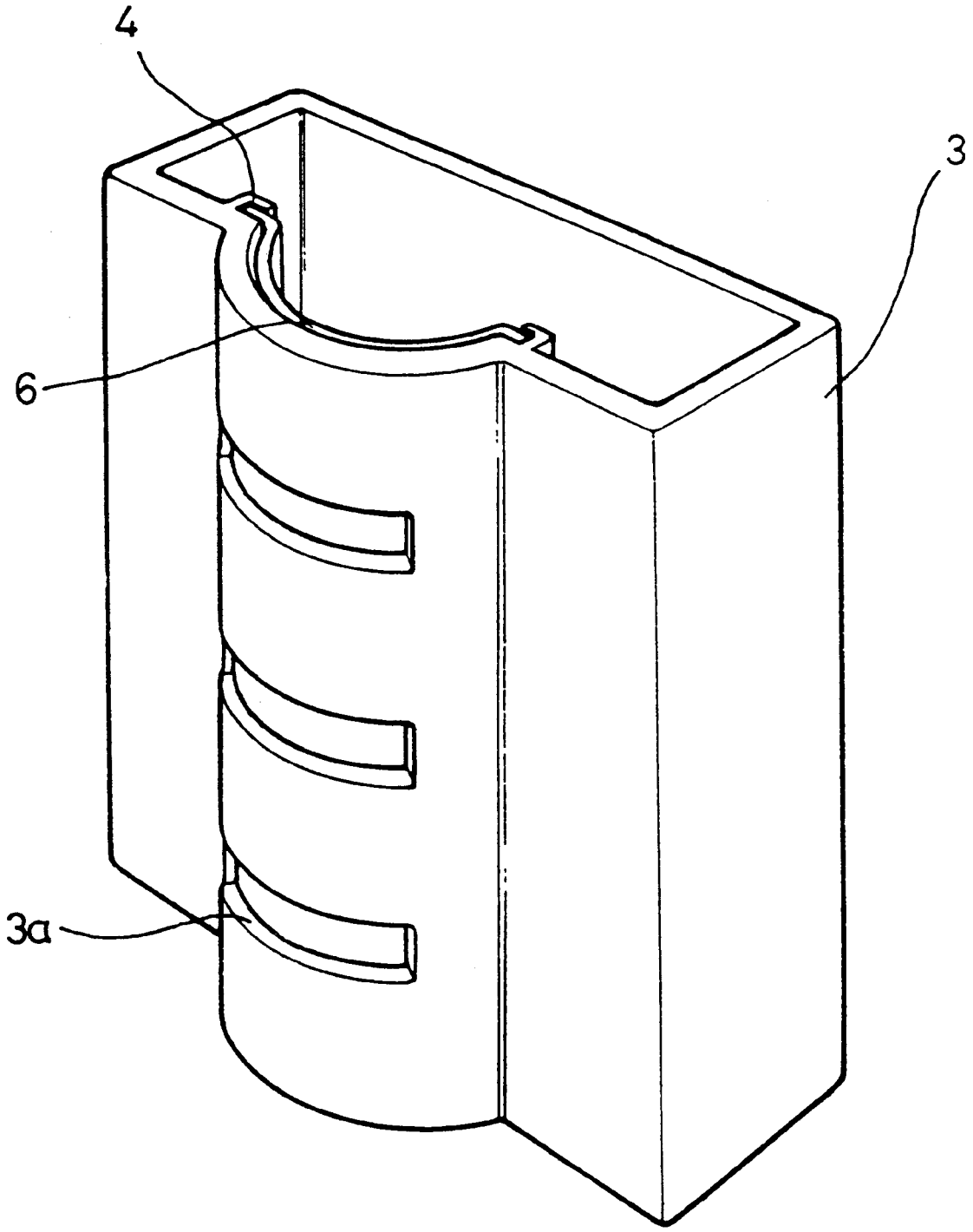
FIG. 3 is an enlarged perspective view of an opening/closing device shown in FIG. 2.
Figure 4:
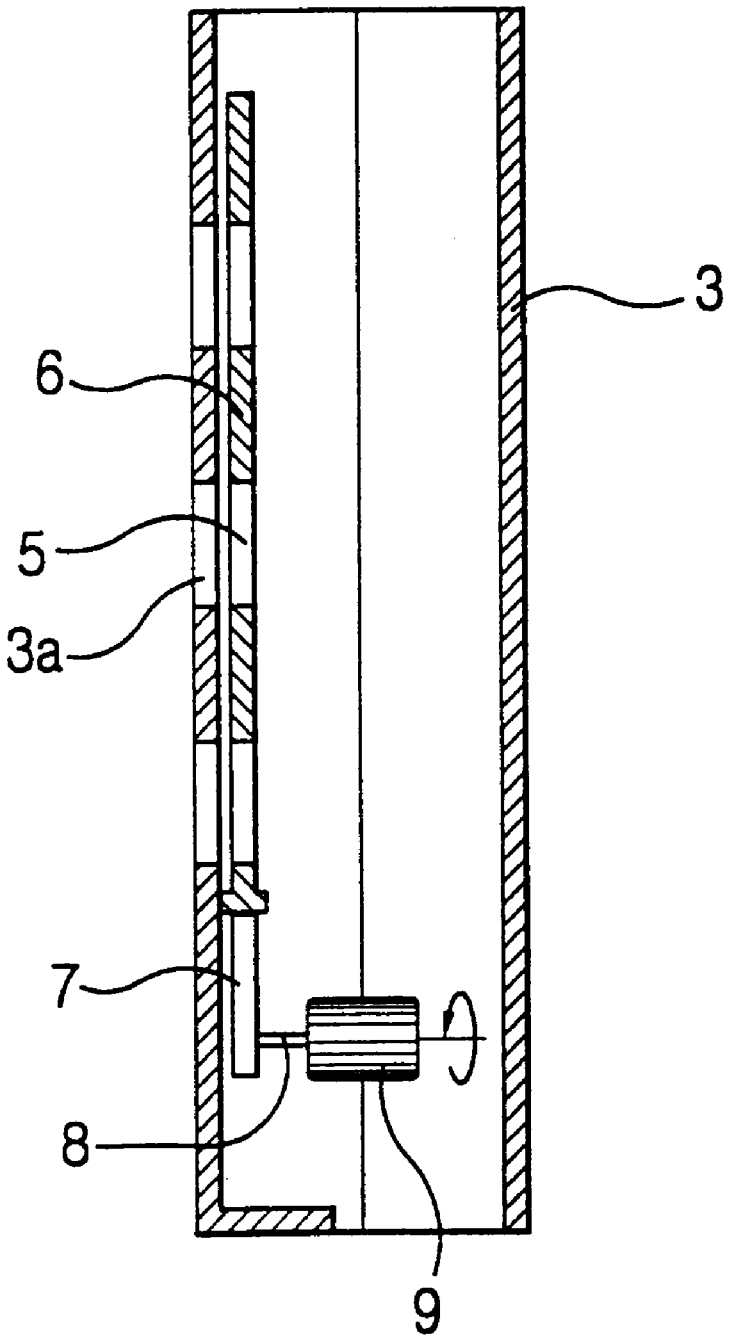
FIG. 4 is a side sectional view of FIG. 3.

FIG. 2 is a side sectional view of a refrigerator according to the present invention, and FIGS. 3 and 4 are enlarged views of an opening/closing device shown in FIG. 2. In the cool air duct 2, an opening/closing device for opening/closing the cool air discharge ports 3*a* is installed. The opening/closing device includes an opening/closing member 6, a cam 7, and a driving motor 9. The opening/closing member 6 is supported by brackets 4 formed at the duct member 3.

The opening/closing member 6 is in close contact with the duct member 3. The opening/closing member 6 is formed with a plurality of air holes 5 corresponding to the cool discharge ports 3*a*. The cam 7 is disposed under the opening/closing member 6 and supports the opening/closing member 6. The opening/closing member 6 keeps in contact with the cam 7 by its own weight.

The driving motor 9 is fixed by a bracket (not shown) at a predetermined position in the cool air duct 2. The cam 7 is installed at a shaft 8 of the driving motor 9. When the driving motor 9 operates, the cam 7 is rotated, and the opening/closing member 6 moves up and down when the cam 7 is rotated. When the opening/closing member 6 is moved up, the cool air discharge ports 3*a* are opened as shown in FIG. 4, and when the opening/closing member 6 is moved down, the cool air discharge ports 3*a* are closed by the opening/closing member 6.

Hereinbelow, the operation and the effect of the refrigerator according to the present invention will be described.

During the cooling operation of the refrigerator, the opening/closing member 6 keeps open state of the cool air discharge ports 3*a* as shown in FIG. 4. When the defrosting operation of the refrigerator begins, a control part which is not shown drives the driving motor to rotate the cam 7, whereby the opening/closing member 6 is moved down and then the cool air discharge ports 3*a* are closed.

Furthermore, when a user opens the door 12 during the cooling operation of the refrigerator, the opening of the door 12 is sensed by a sensor (not shown) for use in sensing the opening/closing of the door 12, and then the control part drives the driving motor 9 to close the cool air discharge ports 3*a* as described above.

As described, the cool air discharge ports 3*a* are closed during the defrosting operation that the heater 17 generates heat and/or when the door 12 opened, and thereby the transmission of the heat from the heater 17 to the fresh food compartment 1 and the transmission of the outside air to the evaporator when the door 12 is opened are prevented. Therefore, the lowering of the cooling efficiency is prevented, and the frost caused by the outside air is not generated on the evaporator 11.

Figure 5:
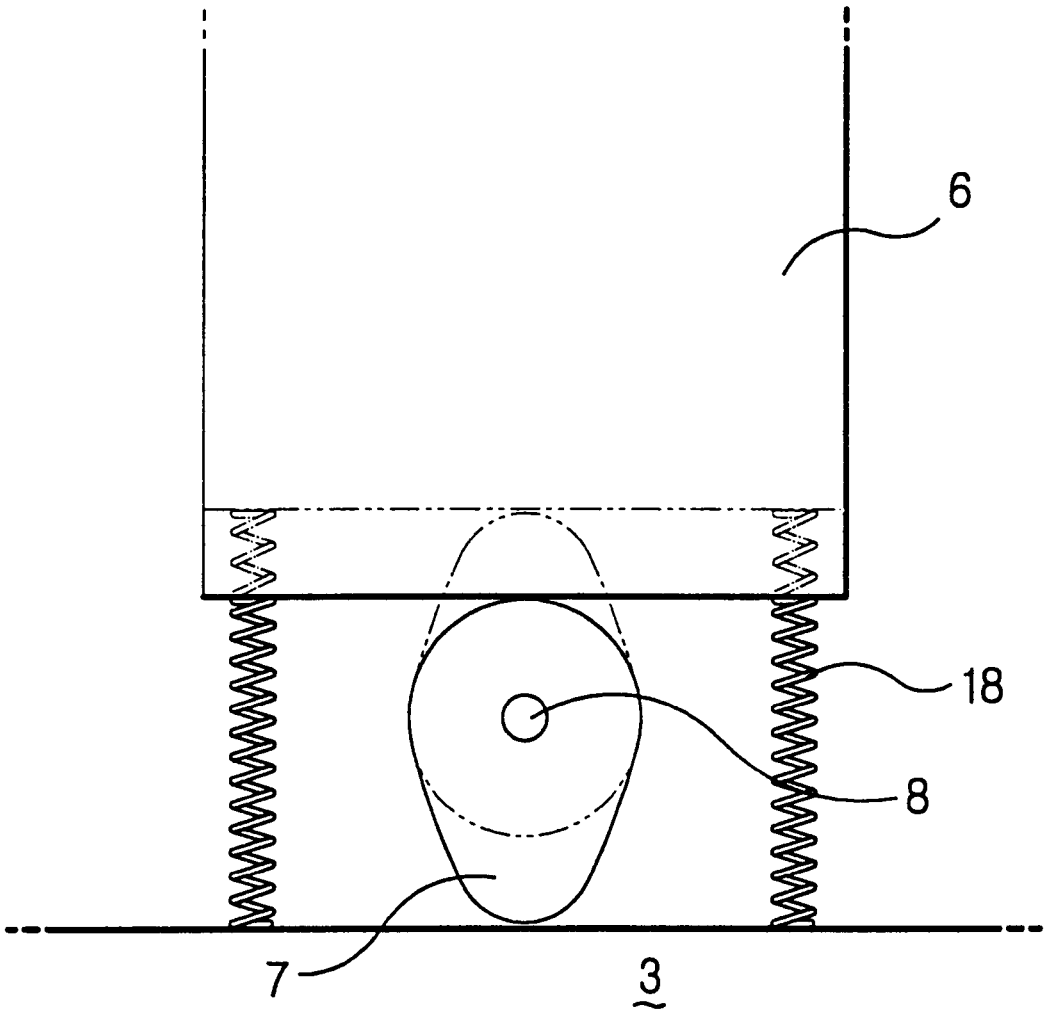
FIG. 5 is a modified example of the opening/closing device shown in FIGS. 2 through 4.

FIG. 5 is a modified example of the opening/closing device shown in FIGS. 2 through 4. In this modified example, the opening/closing device is equipped with a spring 18 for applying a downward elastic force to the opening/closing member 6. The spring 18 connects the bottom of the duct member 3 and the bottom of the opening/closing member 6. The opening/closing member 6 comes in close contact with an outer peripheral cam surface of the cam 7 by the spring 18, and the up-and-down movement of the opening/closing member 6 due to the rotation of the cam 7 is efficiently performed.

Figure 6:
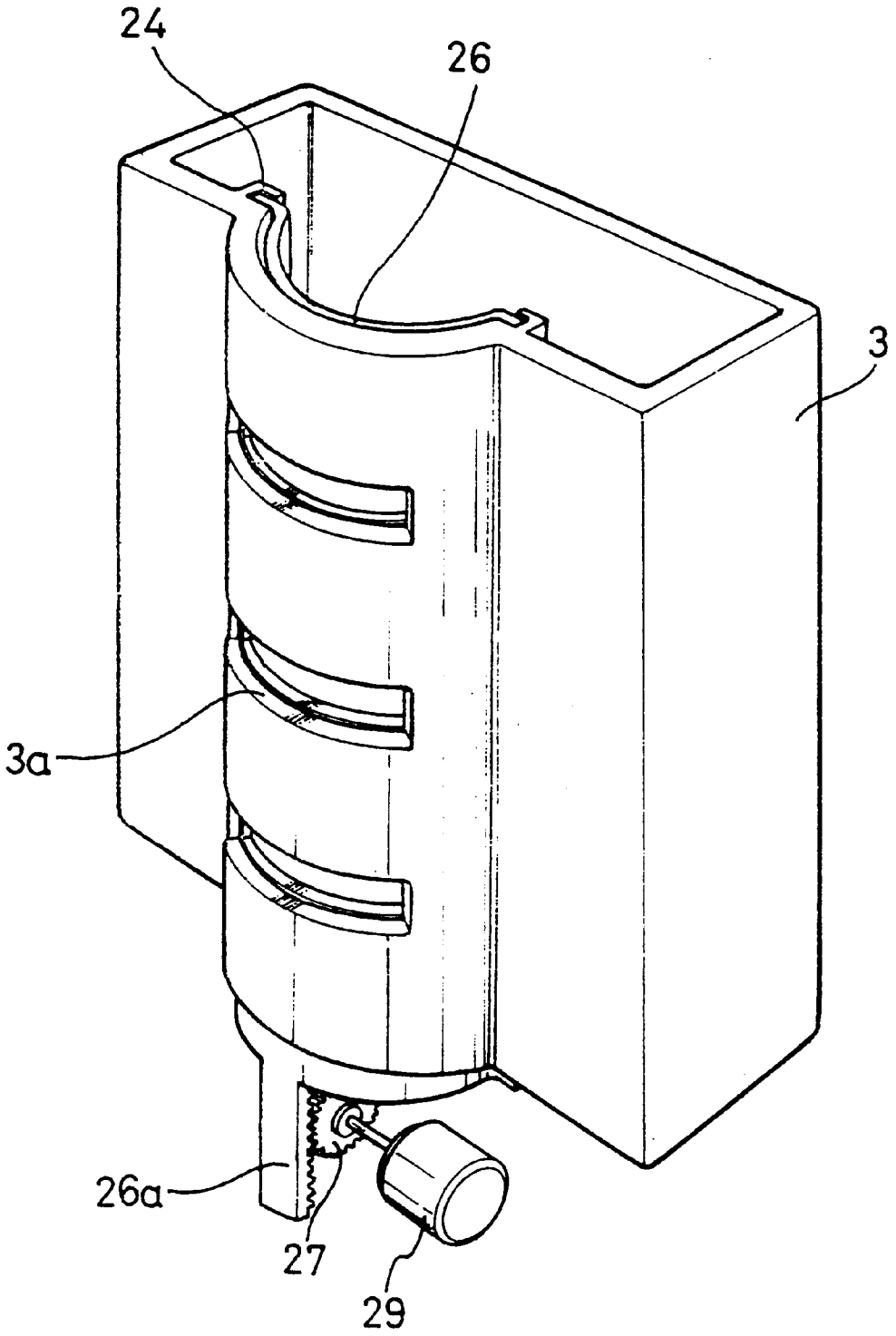
FIG. 6 is an enlarged perspective view of an opening/closing device according to the second embodiment of the present invention.
Figure 7:
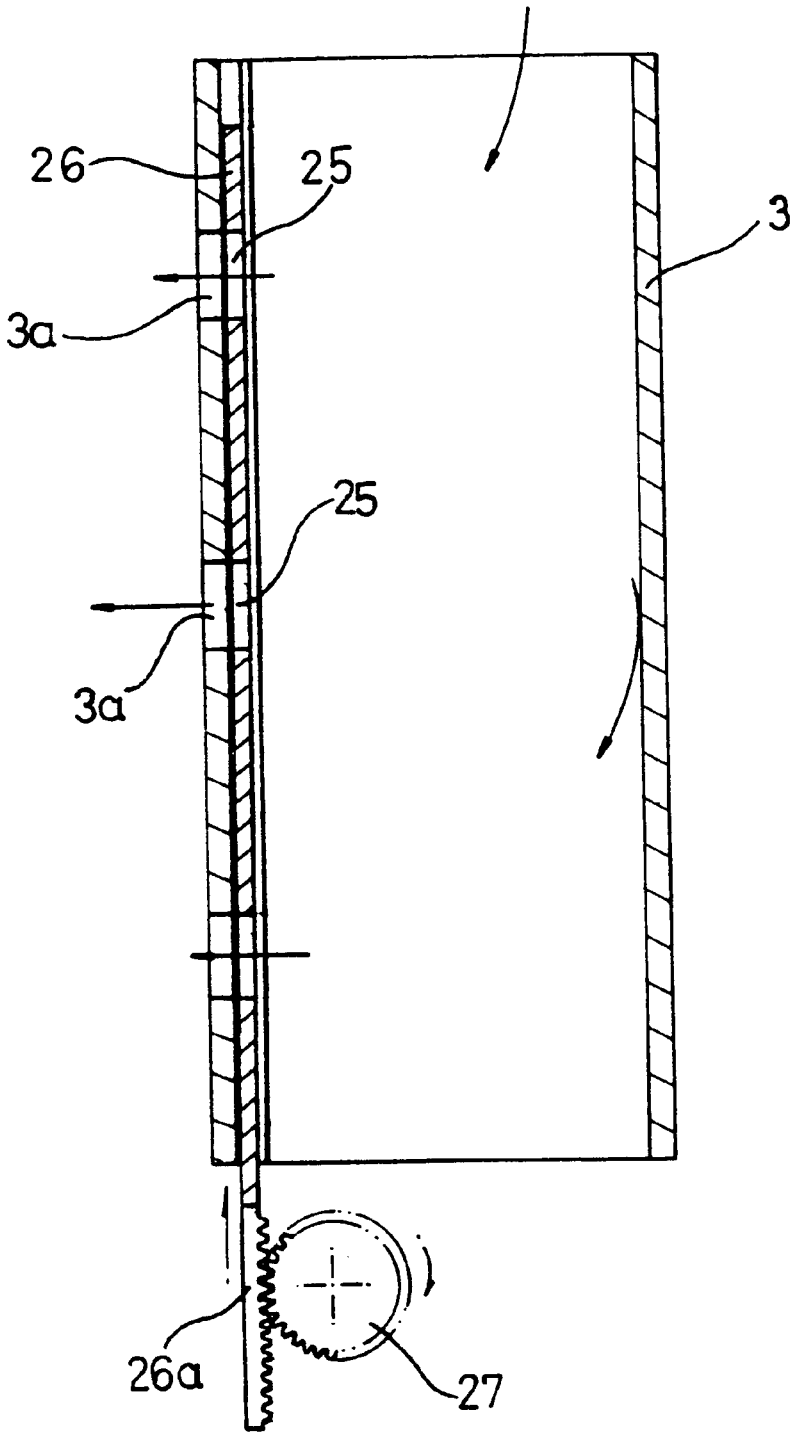
FIG. 7 is a side sectional view of FIG. 6.

FIG. 6 is an enlarged perspective view of an opening/closing device according to the second embodiment of the present invention, and FIG. 7 is a side sectional view of FIG. 6.

In this embodiment, the opening/closing device includes an opening/closing member 26 being formed with a plurality of air holes 25 corresponding to the cool air discharge ports 3*a* of the duct member 3, a rack 26*a* being formed at the lower part of the opening/closing member 26 in a body with the opening/closing member 26, a pinion 27 engaged with the rack 26*a*, and a driving motor 29 for driving the pinion 27. The opening/closing member 26 is supported by brackets 24 formed at the duct member 3.

When the pinion 27 is rotated by the driving motor 29, the opening/closing member 26 is moved up and down. When the opening/closing member 26 is moved up, the cool air discharge ports 3*a* are opened, and when the opening/closing member 26 is moved down, the cool air discharge ports 3*a* are closed. The operation of the opening/closing member 26 is the same with that of the embodiment shown in FIGS. 2 through 4. That is, the opening/closing device closes the cool air discharge ports 3*a* during the defrosting operation and/or when the door 12 is open.

Figure 8:
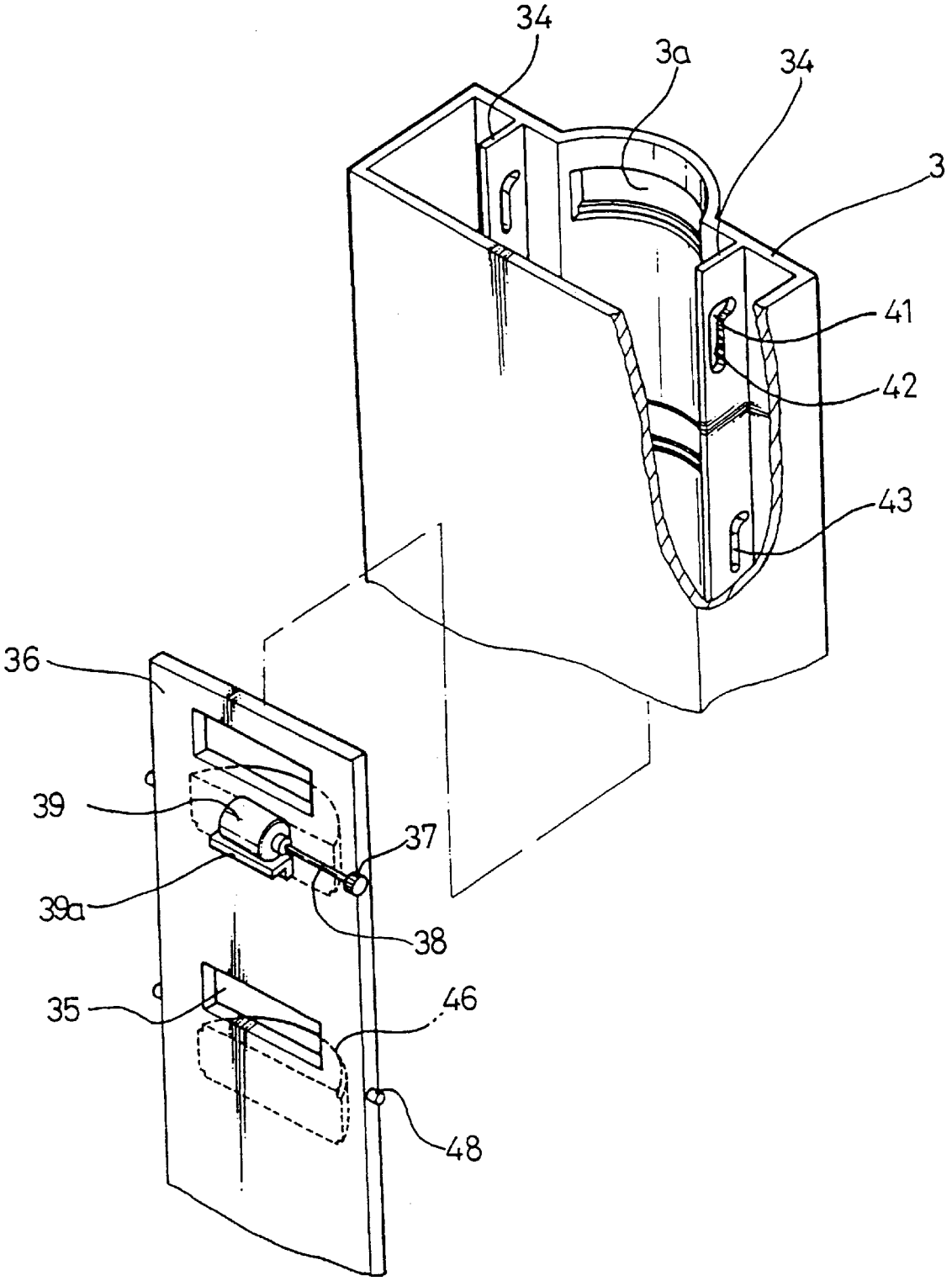
FIG. 8 is an enlarged rear perspective view of an opening/closing device according to the third embodiment of the present invention.
Figure 9:
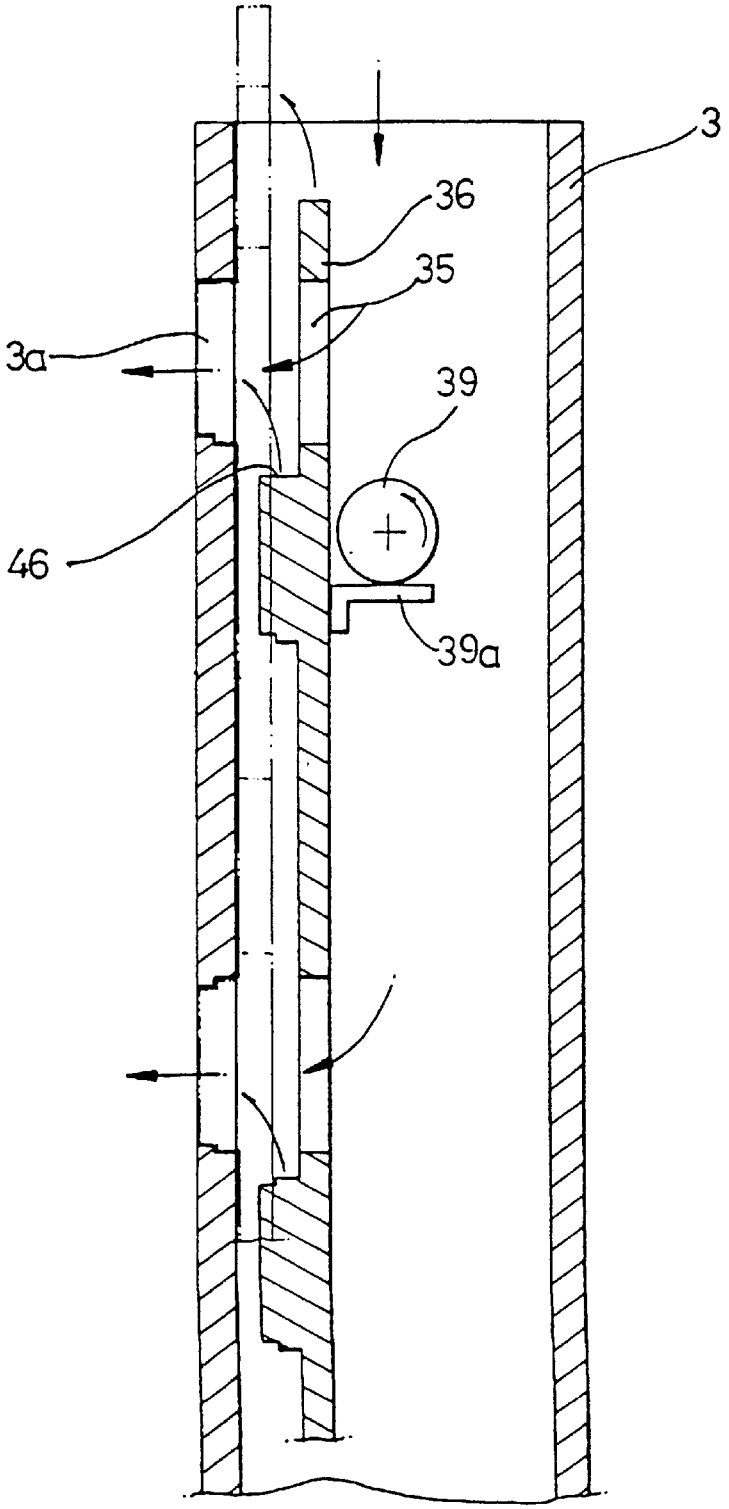
FIG. 9 is a side sectional view of FIG. 8.

FIG. 8 is an enlarged rear perspective view of an opening/closing device according to the third embodiment of the present invention; and FIG. 9 is a side sectional view of FIG. 8.

In the present embodiment, the opening/closing device includes an opening/closing member 36 being formed with a plurality of air holes 35 corresponding to the cool air discharge ports 3*a* of the duct member 3, a driving motor fixed on the opening/closing member 36 by a fixing bracket 39*a*, and a driving gear 37 installed at the shaft 38 of the driving motor 39.

A plurality of protrusion parts 46 are formed at the frontal side of the opening/closing member 36. The protrusion parts 46 are form-fittingly inserted into the cool air discharge ports 3*a* when the opening/closing member 36 closes the cool air discharge ports 3*a*. Therefore, the cool air discharge ports 3*a* are airtightly closed.

A guide protrusion 48 is formed at the side of the opening/closing member 36. The guide protrusion 48 is inserted into a guide hole 43 which will be illustrated later.

The duct member 34 is formed with a guide bracket 34 for guiding the movement of the opening/closing member 36 along a vertical direction, and a long hole 41 is formed at the guide bracket 34. The long hole 41 is formed vertically, and the upper part thereof is bent toward the frontal side. a gear part 42 is formed at the inner side of the long hole 41.

The driving gear 37 is inserted into the long hole 41, and it is engaged with the gear part 42 formed at the long hole 41. When the driving gear 37 is rotated by the driving motor 39, the driving gear 37 is moved up and down in the long hole 41. Then the driving motor 39 is moved up and down, and the opening/closing member 36 on which the driving motor 39 is fixed is moved up and down.

The guide bracket 34 is formed with a guide hole 43. The guide hole 43 is formed into a shape substantially the same with the shape of the long hole 41. The guide protrusion 48 of the opening/closing member 36 is inserted into the guide hole 43, whereby the up-and-down movement of the opening/closing member 36 is efficiently guided.

When the driving motor 39 begins to operate, the driving gear 37 moves up along the long hole 41, and thereby the opening/closing member 36 moves up. As the rotation of the driving motor 39 is continued, the opening/closing member 36 is moved toward the frontal side along the long hole 41. Then the opening/closing member 36 comes in contact with the inner side of duct member 3. In this situation, since the long hole 41 is formed along the insertion direction of the protrusion parts 46 to the cool air discharge ports 3*a*, the protrusion parts 46 are easily inserted into the cool air discharge ports 3*a*. When the driving motor 39 is driven in a reverse direction, the opening/closing member 36 is moved down, and the cool air discharge ports 3*a* are opened.

As described above, according to the present invention, since the heat exchange between the evaporator and the outside air is prevented during the defrosting operation and when the door is open, the cooling efficiency is enhanced and the frost caused by the outside air is not generated on the evaporator.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator comprising:

a cooling compartment;

a door for opening/closing said cooling compartment;

an evaporator for generating cool air to be supplied into said cooling compartment by evaporating refrigerant;

a heater for removing frost generated on said evaporator;

a duct member for forming a cool air duct into which the cool air generated by said evaporator flows, said duct member being formed with a plurality of cool air discharge ports opened in said cooling compartment; and an opening/closing device including an opening/closing member being in close contact with said duct member, said opening/closing member being formed with air holes alignable with the cool air discharge ports, and a motor-driven actuator operably connected to said opening/closing member for moving said opening/closing member to position said air holes selectively in or out of alignment with said cool air discharge ports, so that said cool air discharge ports are opened/closed by said opening/closing member, wherein said motor-driven actuator comprising a motor-driven cam situated beneath said opening/closing member for raising and lowering said opening/closing member, said cam having an outer peripheral cam surface, said opening/closing device further including a spring arranged for forcing said opening/closing member into contact with said outer peripheral cam surface whereby rotation of said cam about an axis causes said outer peripheral cam surface and said spring to move said opening/closing member;

wherein said opening/closing device closes the cool air discharge ports during a defrosting operation of said heater and/or when said door is open.

* * * * *